US006233766B1

(12) United States Patent
Öhman

(10) Patent No.: US 6,233,766 B1
(45) Date of Patent: May 22, 2001

(54) FOLDABLE CARRIER

(76) Inventor: Gerth Öhman, Box 30, S-892 21, Domsjö(SE)

( * ) Notice: Subject to any disclaimer, the term of this patent is extended or adjusted under 35 U.S.C. 154(b) by 0 days.

(21) Appl. No.: 09/368,190

(22) Filed: Aug. 4, 1999

Related U.S. Application Data

(63) Continuation-in-part of application No. 09/089,749, filed on Jun. 2, 1998, now abandoned, which is a continuation-in-part of application No. 08/776,260, filed on Jan. 21, 1997, now abandoned.

(51) Int. Cl.[7] ..... A47C 23/00
(52) U.S. Cl. ..... 5/627; 5/722; 5/657
(58) Field of Search ..... 5/627, 640, 722, 5/655.9, 656, 657

(56) References Cited

U.S. PATENT DOCUMENTS

| | | | |
|---|---|---|---|
| 814,654 | 5/1906 | Kee . | |
| 836,326 | 11/1906 | Kinyon . | |
| 1,271,496 | 7/1918 | Wilson . | |
| 1,785,252 | 12/1930 | Frank . | |
| 3,319,273 | 5/1967 | Solin . | |
| 3,360,806 | 1/1968 | Dunaway . | |
| 4,137,583 | 2/1979 | Baldwin et al. . | |
| 4,168,554 | 9/1979 | Hindes . | |
| 4,231,127 | 11/1980 | Bendell . | |
| 4,524,473 | 6/1985 | Fanti . | |
| 4,969,223 | 11/1990 | Yamaguchi . | |
| 4,985,952 | 1/1991 | Edelson . | |
| 4,987,625 | 1/1991 | Edelson . | |
| 5,491,851 * | 2/1996 | Alonson | 5/722 |
| 5,513,402 | 5/1996 | Schwartz . | |
| 5,867,849 | 2/1999 | Pontrello . | |

FOREIGN PATENT DOCUMENTS

| | | |
|---|---|---|
| 0 004 204 A2 | 9/1979 | (EP) . |
| 0 432 330 A1 | 6/1991 | (EP) . |
| WO 87/04614 | 8/1987 | (WO) . |
| WO 89/09039 | 10/1989 | (WO) . |

* cited by examiner

*Primary Examiner*—Lynne H. Browne
*Assistant Examiner*—Fredrick Conley
(74) *Attorney, Agent, or Firm*—Fasth Law Offices; Rolf Fasth

(57) ABSTRACT

The foldable carrier comprises first elongate flexible layers that has a first thickness with longitudinal opposite side edges. A second elongate layer is made of a porous soft material that has a second thickness and is secured to the first elongate flexible layer. The second thickness is substantially greater than the first thickness. A first stretcher side section is secured to a first carrier layer and is pivotally attached to one of the side edges of the first elongate flexible layer. The first stretcher side section is movable between an expanded position and a folded position so that the first carrier layer is movable towards the first elongate flexible layer to face the first elongate flexible layer when the first stretcher side section is in the folded position. The first elongate layer and the first carrier layer form a continuous uninterrupted surface attached to the second elongate flexible layer and the first stretcher side section.

8 Claims, 5 Drawing Sheets

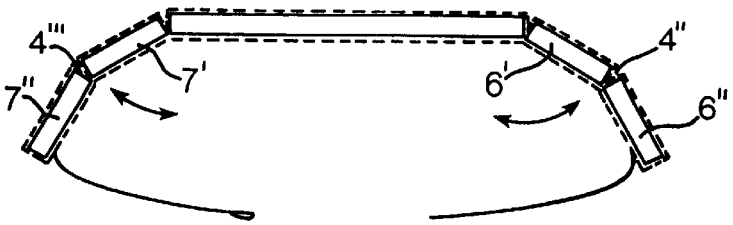
FIG. 6
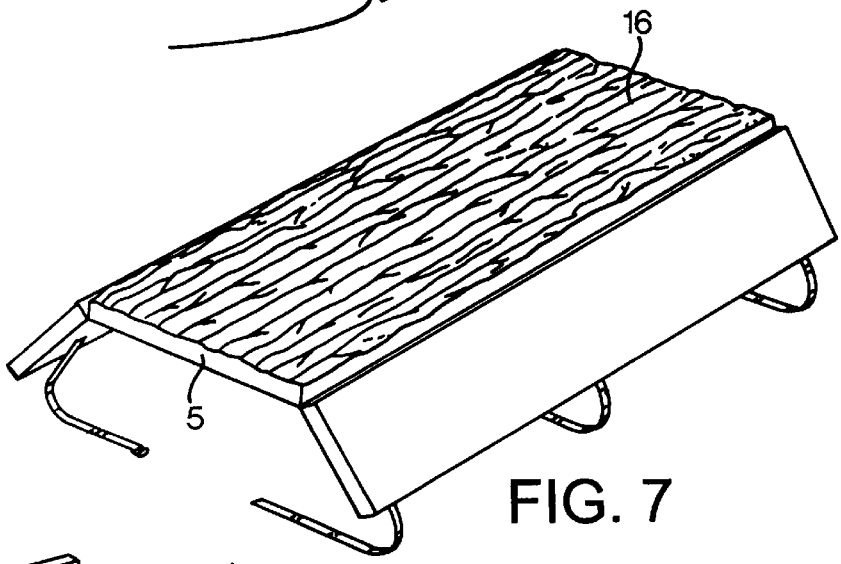
FIG. 7
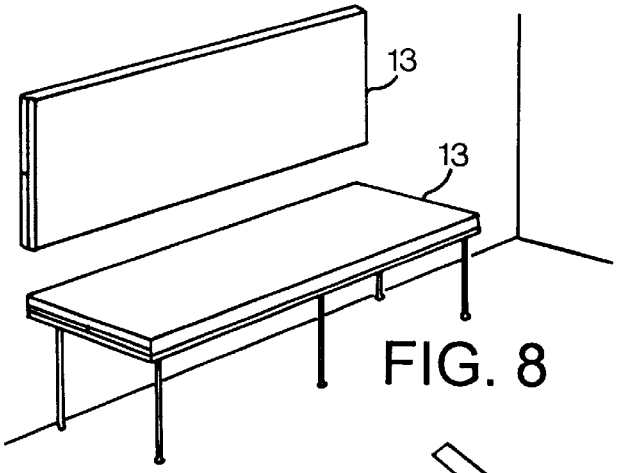
FIG. 8
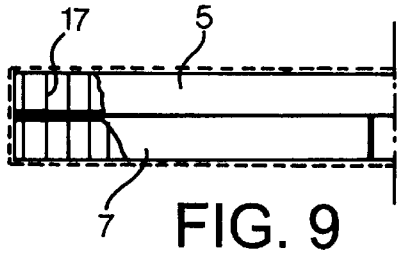
FIG. 9
FIG. 10a
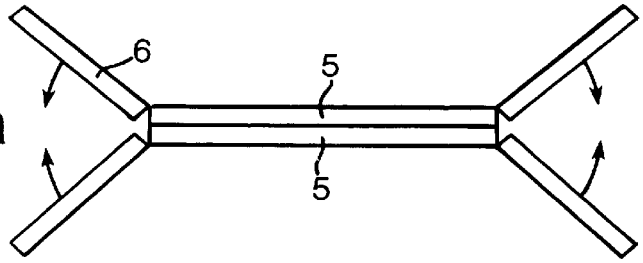
FIG. 10b
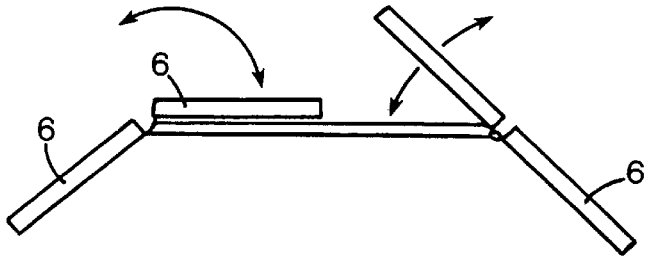

FOLDABLE CARRIER

PRIOR APPLICATION

This is a continuation-in-part application of application Ser. No. 09/089,749 now abandoned, filed Jun. 2, 1998 which is a continuation-in-part of application Ser. No. 08/776,260, filed Jan. 21, 1997 (abandoned).

BACKGROUND AND SUMMARY OF THE INVENTION

The present invention relates to a foldable carrier such as a stretcher comprising on the one hand a thin first layer of an all-round flexible material of large wear and tear strength, having a substantially elongate basic form and forming a carrier, for instance for enabling the use of the carrier as a stretcher, and on the other hand a considerably thicker second layer of elongate basic form which is permanently joined or integrated with the carrier layer and which consists of a porous or fluffy soft material being intended for forming a stretcher part for enabling a comfortable reclining upon the underlay.

According to the stretcher of the present invention, two layers are, preferably, intimately integrated with another being formed of one and the same polymer material, for instance polyethylene, the thin carrier layer having a thickness of about 0.6 to 1 mm and a density of 0.9 to 1.0 kg/dm$^3$, while the thick, porous layer has a thickness of about 5 mm and a density which is many times lower, for instance about 0.05 kg/dm$^3$. Thus, according to its preferred embodiment, the stretcher has a total thickness of around 6 mm; this making it possible to roll it into a spirally wound roll which can be stored in an easy way, e.g. on or in a rucksack. A substantial advantage is that, when needed, it may be quickly and smoothly used as a stretcher. Of this reason, this product is particularly well suited for being stretcher may advantageously be included into the pack of a soldier and fulfil a double function for serving not only as a heart insulating and a point load equalizing sleeping underlay on the top of a bed of brushwood or similar, but also as a flexible stretcher construction in the case when the soldier or persons in his proximity would be injured. However, a shortcoming of this stretcher is that its limited thickness (6 mm in the preferred embodiment) gives a very mediocre, if not to say a directly bad shock absorbing and load distributing capacity. Thus, if the underlay is laid directly upon a hard, plane surface, e.g., upon a stiff bottom of a bed, the comparatively thin, porous layer does not offer any reposing comfort whatsoever.

Another general shortcoming of the prior art technology is the fact that stretchers rarely or never are accessible in a satisfactorily large number at or in the proximity of general establishments of different sorts. For instance, in railway and underground train sets often only one, or possibly a few stretchers (in worst case, none at all) are in readiness, which, what is more, not seldom are stowed away in difficultly accessible spaces, occasionally forgotten by the responsible staff. If an accident with many injuries on humans occurs, then the absence of sufficiently many easily accessible stretchers constitutes a circumstance which makes the required rescue work more difficult and retards it, sometimes to such an extent that the injuries are seriously aggravated and even become fatal.

The present invention aims at further developing the underlay unit known from WO87/04614 in such a way that, besides being usable as a stretcher, it also may be used as a comfortable stretcher directly upon a plane, hard surface.

Thus, a primary object of the invention is to create an underlay unit which in a state of readiness, in which it is ready to be quickly used as a stretcher, may be used in a general way as a shock absorbing and/or load distributing soft unit, e.g., as an effect or part of an effect. In other words, during a long time in a storage or readiness state the unit shall be usable as a shock absorbing and/or supporting soft part, e.g. in the shape of a support-forming part of the back or a seat-forming part, whereafter it shall be possible to quickly and easily convert it into a stretcher.

Different forms of flexible mattresses for rescuing and patient evacuating proposes are previously disclosed in WO-A-91/18576, U.S. Pat. No. 4,124,908, U.S. Pat. No. 4,186,453 and U.S. Pat. No. 4,442,557. However, these mattresses lack the slits in the mattresses which are characteristic for the present invention and which form longitudinal folding lines in order to make possible a folding of the mattresses into a package.

Further, in WO-A-86/02814 a mattress-like bed underlay is disclosed which is capable of being folded into a seat-forming package. However, in this case, the folding takes place laterally, the bed underlay lacking any sort of longitudinal slits of the sort that characterizes the invention. Nor is the underlay shown in this document capable of being used as a stretcher. Furthermore, the Norwegian design registration No. 68206 provides the mattress with lateral folding notches.

BRIEF DESCRIPTION OF THE DRAWINGS

FIG. 6 is an end view illustrating a further alternative embodiment of the stretcher;

FIG. 7 is a perspective view corresponding to FIG. 1, showing an embodiment with an alternative design of a surface of the stretcher;

FIG. 8 is a schematic perspective view illustrating the use of the stretcher as a part of an interior;

FIG. 9 is a partially cut end view showing a stretcher provided with aeration channels;

FIG. 10*a* is an end view showing an embodiment with two side panels just being enclosed into a common envelope;

FIG. 10*b* is an end view showing an embodiment similar to the embodiment in FIG. 10*a* but the embodiment has no thick middle section;

DETAILED DESCRIPTION

Figure 1:
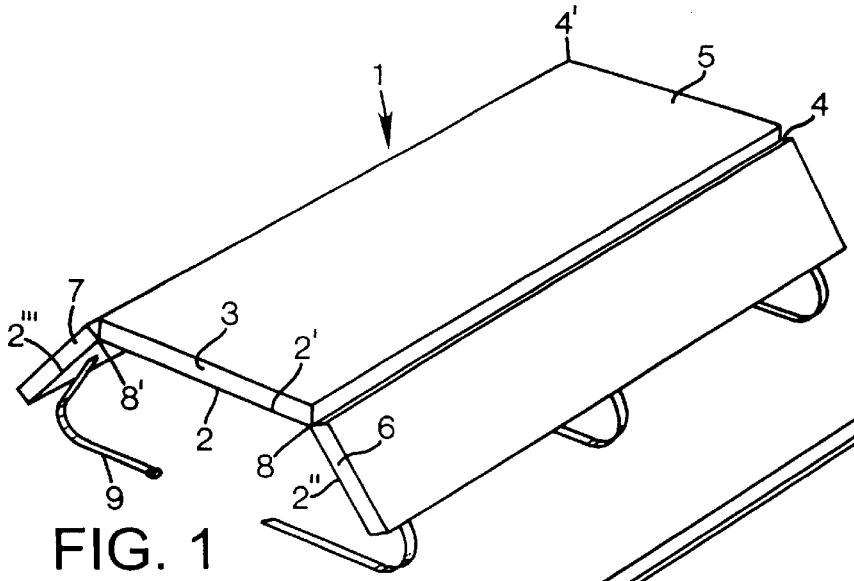
FIG. 1 is a perspective view showing a stretcher according to the present invention.

FIG. 1 shows a stretcher which in its entirety is designated by reference numeral 1 and which comprises on the one hand a thin first layer 2 of an all-round flexible material with large wear and tear strength, and on the other hand a considerably thicker second layer 3 which is permanently joined or integrated with the first layer and consists of a porous or fluffy soft material intended to form a stretcher part that makes it possible to comfortably repose on it. Advantageously, the two layers 2, 3 may be produced in the way disclosed in WO-A-87/04614, i.e., of one and the same polymer material, for instance polyethylene or polypropylene, the material in the strong, thin and carrier layer 2 having a density many times larger than the density of the porous layer 3. However, it is also possible to produce the two layers of different materials and then connect them to each other, for instance by some sort of adhesive or by heat welding. In the shown example, each of the two layers as a rectangular basic form, although it is feasible to confer to them a slightly tapering form. However, in both cases the basic form is elongate in so far as the length of the stretcher always is larger than its largest width.

According to the invention, layer 3 forming the soft stretcher part of the stretcher is divided by one or several longitudinal slits 4, 4' into several elongate sections 5, 6, 7 which are jointly held together by the thin carrier layer 2. More precisely, the holding together of the stretcher sections 5, 6, 7 is effected in portions 8, 8' which form longitudinal folding lines permitting a folding of the stretcher into a package in which the two sections 6, 7 are folded inwardly towards the middle section 5, with the carrier layer parts 2', 2", 2"' turned towards each other.

According to an embodiment of the invention preferred in practice, the stretcher part 3 has a thickness of at least 30, suitably at least 50 mm, whereby the stretcher in question is capable of being used as a conventional stretcher, in particular in its folded configuration, for instance in a hospital bed. According to the example in FIG. 1, the stretcher part, i.e. the thick soft layer 3, is supposed to have a thickness of 50 mm, at the same time as the length of the stretcher amounts to a size of 2000 mm. Advantageously, middle section 5 then has a width within the range of 600 to 900 mm, while the width of each separate side section 6, 7 amounts to about half of the width of middle section 5. Therefore, in the folded state shown in FIG. 3 the stretcher gets the form of about 2000 mm and a width within the range of 600 to 800 mm. Of course, also the length, the width and the thickness may deviate from these absolute values.

As may be seen in FIG. 1, straps 9 may be connected to the thin and strong carrier layer 2, which straps on the one hand may consist of carrying straps, on the other hand of straps for holding together the side portions against the body of a lying person.

According to a preferred embodiment of the invention, each individual dividing slit 4 has a height equal to the thickness of stretcher part 3 in order to cut the latter down to carrier layer 2. In other words, the dividing slits keep side section 6, 7 completely separate from middle section 5. Therefore the user may replace the middle section 5 for her own middle section, such as his own mattress, without affecting the foldability of the present invention. The folding is carried out solely along previously mentioned portions 8, 8' of carrier layer 2.

Although side sections 6, 7 are equally wide according to the example in FIG. 1, they may also be differently wide.

Figure 2:
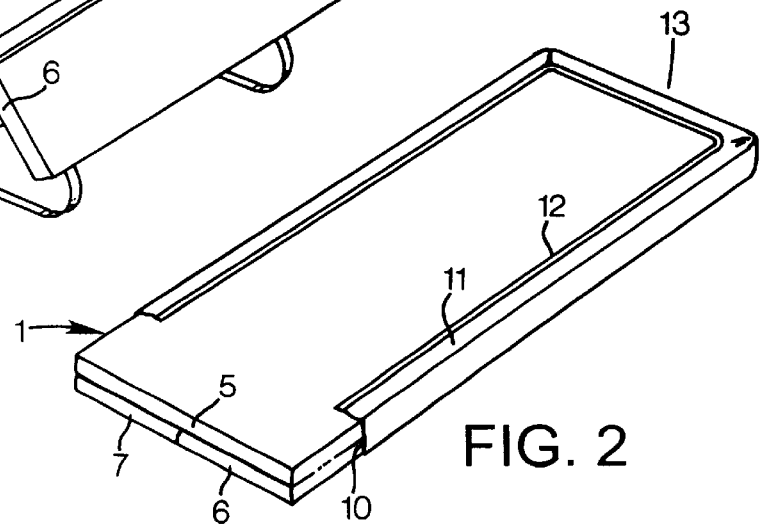
FIG. 2 is a perspective view showing the same stretcher in a folded state of readiness in which is packed in a covering envelope.

According to a preferred embodiments of the invention, the stretcher being folded along the folding lines in question is packed into an enclosing, flexible envelope. One feasible embodiment of such an envelope 10 is shown in FIG. 2. In this case, the envelope comprises a large-surface which is placed against the inwardly folded side sections 6, 7 and against the edge parts 11 extending along both the long and the short sides, which edge parts 11 are kept elastically strained against the upper side of middle section 5, for instance by a flexible straining bad 12, for example in the form of a rubber band. Advantageously, envelope 10 consists of a suitable textile material, e.g. terry cloth, furniture fabric or similar. It should be obvious that envelope 10 may be easily and quickly pulled off from the packed stretcher in order to make it possible for the later to function as a stretcher. According to an essential aspect of the present invention, the unit 13 shown in FIG. 2 and comprising both the packed stretcher 1 and the enclosing envelope 10, may be used as an effect in the most diverse circumstances, e.g., as a support-forming part for the back or as a seat-forming part, for instance in a room or in a vehicle. Thus, in its storage or readiness state, the unit may during long times be used as for instance a furniture forming element, whereafter it may be rapidly converted into a rescuing stretcher. This brings about the essential advantage of keeping a large quantity of stretches easily accessible in different public institutions, such as on trains, public buildings, department stores, etc.

Figure 3:
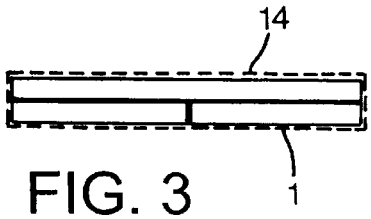
FIG. 3 is a schematic cross-section showing the stretcher packed in another envelope.
Figure 4:
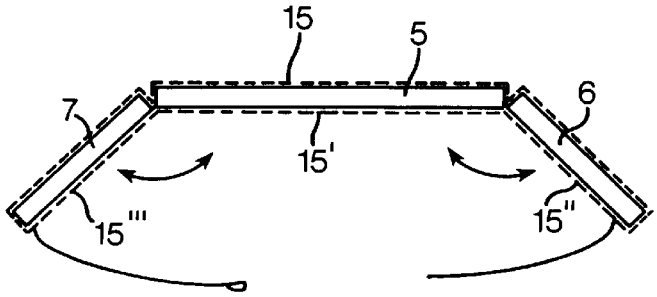
FIG. 4 is a similar end view showing three different sections comprised by the stretcher and each one being separately covered by different parts of a covering envelope.

In FIG. 3 an alternative envelope 14 is shown which encloses and covers the two opposite large-surfaces of the package and at least the longitudinal side edges, in that the envelope is endless. According to this embodiment, the envelope may also cover the short-ends of the package. Also in this case, the envelope may consist of a textile material, although also other materials are feasible, e.g., shrinking plastic, adhering plastic or similar. It should be observed that envelope 14, equally to envelope 11, holds together stretcher sections 5, 6, 7 and locks these relative to each other in the folded state.

Figure 5:
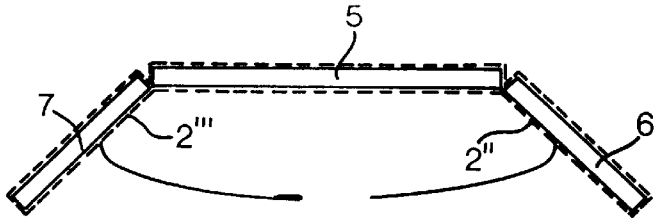
FIG. 5 is an end view showing an alternative embodiment of the stretcher.

In FIG. 5 an alternative embodiment is shown according to which an envelope 15 comprises three different sectors 15', 15", 15"', each separately enclosing the different stretcher sections 5, 6, 7. Thus, in this case the envelope is placed on the stretcher when the different stretcher sections are folded out or are in a common plane, the envelope enclosing the stretcher sections all-round and being on contact with their surfaces.

In FIG. 5 an embodiment is shown according to which carrier layer parts 2", 2"' have a smaller width than side sections 6, 7 of the stretcher part. In this embodiment, the outer longitudinal side parts of the side sections become more flexible and softer than at the embodiment according to FIG. 1.

FIG. 6 shows an embodiment according to which each individual side section is divided into two part-sections 6', 6" and 7', 7", respectively, by a corresponding dividing slit 4", 4"'. In this embodiment, the side sections are capable of being more easily connected to the body of a patient.

In FIG. 7 an embodiment is shown according to which the upper surface 16 on the middle section 5 of the stretcher part has been conferred an uneven surface structure, for instance in the form of longitudinal graining, with the object of reducing the risk for bedsores in cases when the stretcher is used for long periods as a stretcher, for instance in a hospital bed.

In FIG. 9 is illustrated an embodiment according to which the different layers in the sections of the stretcher have been made with through aeration channels 17 which promote the evacuation of humidity and vapor from the stretcher and which may bring about a current of air upwards towards a reposing body, for instance by bringing air to the boundary zone between the stretcher sections.

FIG. 10*a* shows an embodiment according to which two identical stretcher are supposed to be laid adjacent to each other, with the lying surfaces of middle sections 5 in contact with each other. According to this embodiment, the side sections are folded inwardly towards the middle sections, thus forming a package of four-fold thickness in comparison with the individual stretcher layer 3, and then the package is enclosed in an envelope. FIG. 10*b* is very similar to the embodiment shown in FIG. 10*a* but has no middle sections 5 so that the user may use his/her own middle section such as a mattress.

Figure 11:
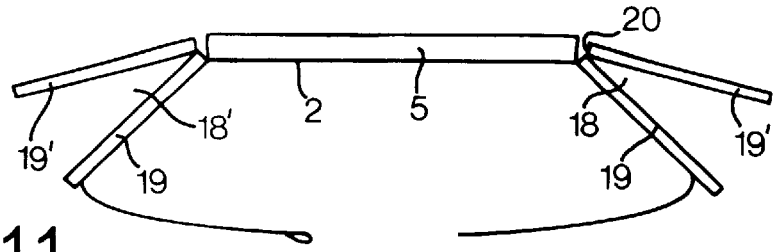
FIG. 11 is an end view showing a further alternative embodiment of the invention.
Figure 12:
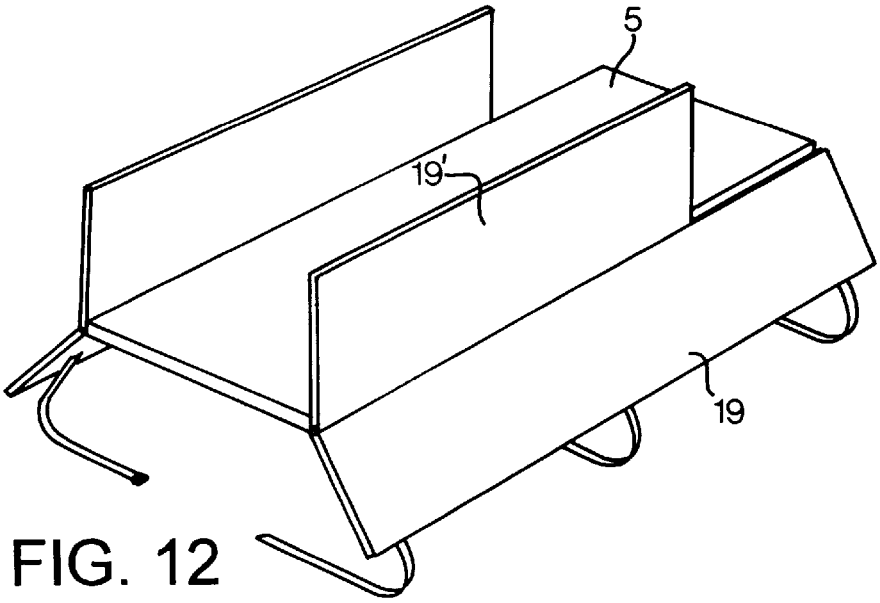
FIG. 12 is a perspective view showing a further alternative embodiment.

FIG. 11 shows an embodiment according to which the individual side section is divided into two lamella-like parts 19, 19' by a slit 18, 18' parallel to the carrier layer 2, which parts 19, 19' are held together along longitudinal side edges by a reinforcing layer 20 which protrudes from carrier layer 2. As can be seen in FIG. 12, the lamella part 19' next to the lying surface of middle section 5 may be shorter than the outer lamella part 19. In this way, the arms of a lying patient or person may be placed between the two lamella parts and be kept locked after the outer lamella parts having been connected to each other, for instance by straps 9. Thus, when the stretcher is used as a stretcher not only the body and the legs of the patient may be held steadily fixed and still, but also the patient's arms, this being important for instance in connection with rescuing operations and other difficult circumstances. When hands and arms are pressed directly at the body, the ribs of the person may break which may cause a puncture of the lungs. Therefore, the foam is an important separator.

Figure 13:
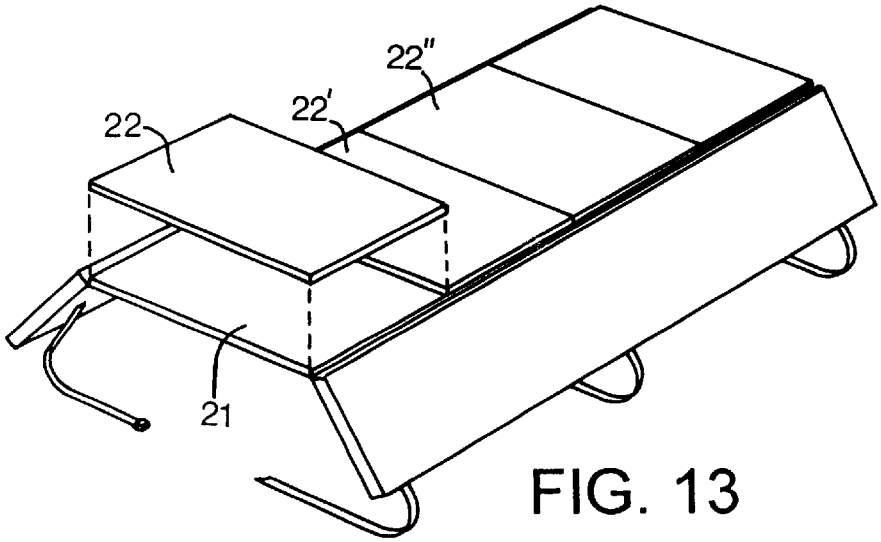
FIG. 13 is a perspective exploded view illustrating a further alternative embodiment of the invention.

Eventually, in FIG. 13 an embodiment is shown according to which the middle section 5 of the stretcher part is composed of on the one hand a lower partial layer 21 and on the other hand of a plurality of superficial part elements 22, 22', etc. These separate surface elements 22, 22' may have different densities in order to satisfy the requirements on the lying surface in the best way, which requirements are different for different parts of the body.

In practice, the longitudinal slits that form folding lines at the different embodiments of the invention, along which lines the different sections of the stretcher may be folded inwardly towards each other, may be brought about in the most different ways. One way is cutting or sawing in the porous material, after its production into a homogeneous continuous stretcher part. The porous material may also be cut with a knife or a heated thread. Another way is to, already in connection with the producing of the porous layer, form the layer so that dividing slits of desired depth and form are immediately formed. In this context it is pointed out that the cross-sectional form of the individual slit may advantageously be triangular or otherwise tapering, so that wedge-wisely tapering edge parts are formed in the stretcher sections adjacent to each other. The slits may also be made by a melting or pressing operation.

It is evident that the invention is not restricted solely to the embodiments described and shown in the drawings. Thus, within the scope of the invention it is feasible to integrate electrically conducting material into the stretcher, for instance by using electrically conducting polymer fibers, which conductivity is so chosen that heat is produced when current is provided. Other ways include providing the foam with a carbon powder or another electrically conductive material. In other words, the stretcher may be kept warm at a temperature suitable for the purpose by the supply of an electrical current. In practice, the electrically conducting material in question should be located in close proximity to the thin carrier layer, so as to avoid the risk of being compressed or stretched in connection with a possible deformation of the stretcher. In this way it is guaranteed that the material always maintains one and the same electrical resistance, thus producing an even heating temperature. Moreover, the geometrical form of the stretcher can vary most considerably. Thus, instead of a rectangular basic shape of the respective stretcher sections also a slightly tapering or wedge-like form may occur. It should also be pointed out that the soft and porous stretcher layer may be composed of two or more part layers. It may also be mentioned that the strong carrier layer 2 may in practice be designed with handles or handle-forming recesses in order to make possible the use of the unit as a stretcher. It is further possible to provide the carrier layer with longitudinal pockets in which stiffening bars may be inserted if desired.

Figure 14:
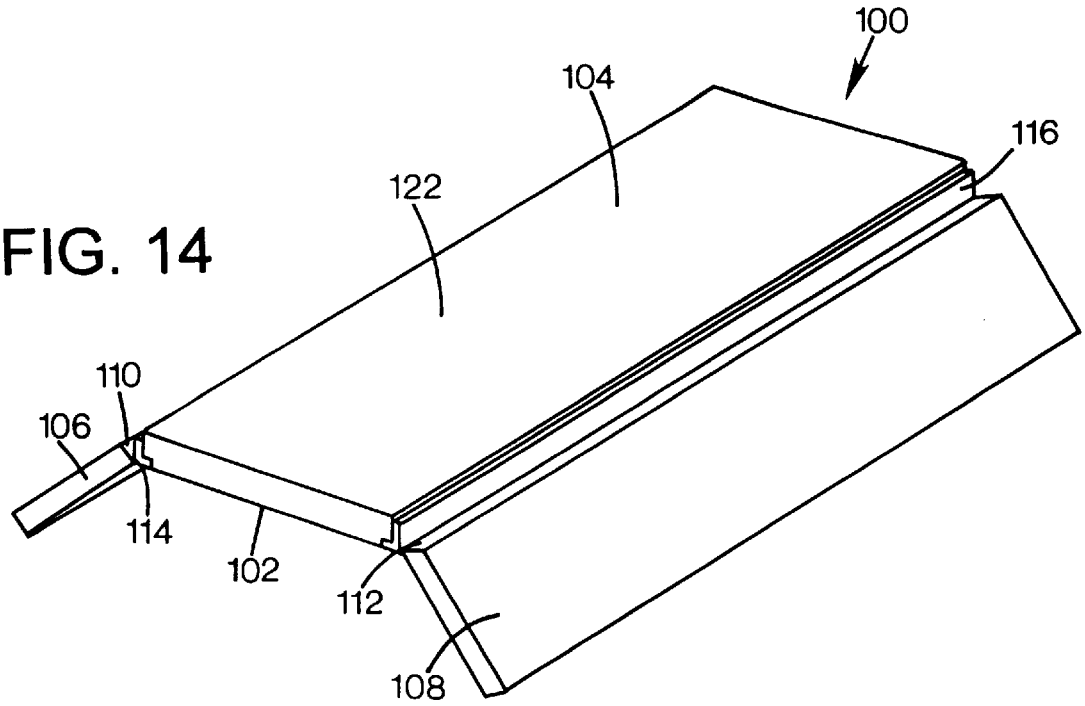
FIG. 14 is a perspective view of the invention in an un-folded position including support members.

FIG. 14 is an alternative embodiment of the present invention. The foldable carrier 100 has a continuous flexible thin support layer 102 that may be made of any flexible material that provides sufficient support to carry a person or animal. A thicker soft middle layer 104 may be attached to the layer 102. On each side of the layer 104, soft side layers 106, 108 may be attached to the layer 102. Preferably, the layers 106, 108 are not attached to the layer 104 so that the carrier 100 may be folded along folding lines 110, 112. Elongate support members 114, 116 may be placed along the folding lines 110, 112, respectively. The layers 104, 106, 108 are soft to make the carrier comfortable for a patient laying in the carrier 100.

Figure 15:
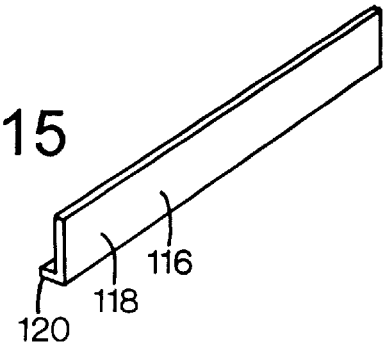
FIG. 15 is a side view of the support member.

FIG. 15 shows a detailed view of the support member 116. The support member is L-shaped and has a long vertical section 118 and a shorter horizontal section 120. The L-shape provides extra stiffness. It should be understood that the support member 116 may have any angled shape and is not limited to L-shapes. As best shown in FIG. 15, the horizontal section 120 may be inserted between the layer 104 and the layer 102 and captured therebetween. The section 118 should be flush or slightly below an upper surface 122 of the layer 104.

Figure 16:
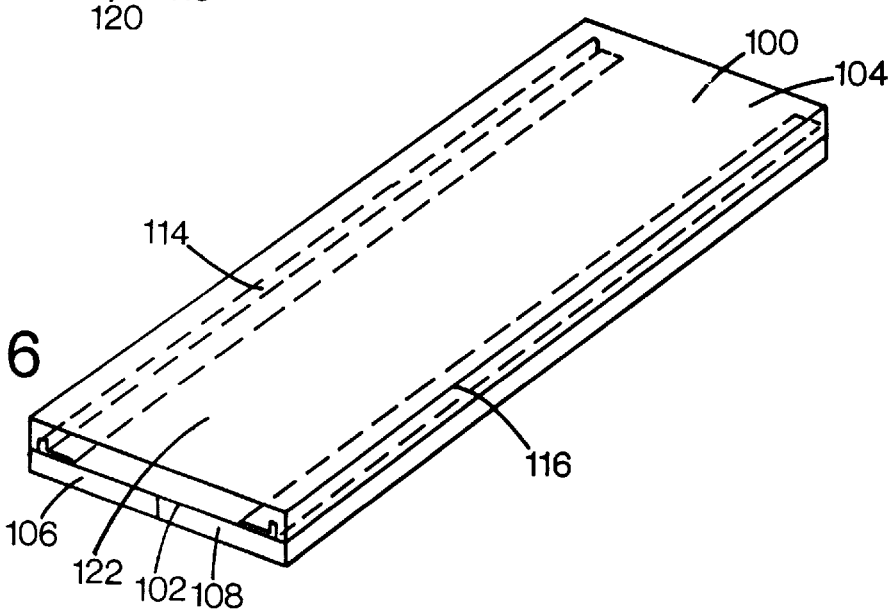
FIG. 16 is a perspective view of the invention in a folded position including support members.

As best shown in FIG. 16, the carrier 100 may be folded into a folded position by turning the side layers 106, 108 towards one another and against the layer 102 below the middle layer 104. It should be noted that the support members 114, 116 may be placed between the side layers 106, 108 and the layer 102 so that they are not lost.

Figure 17:
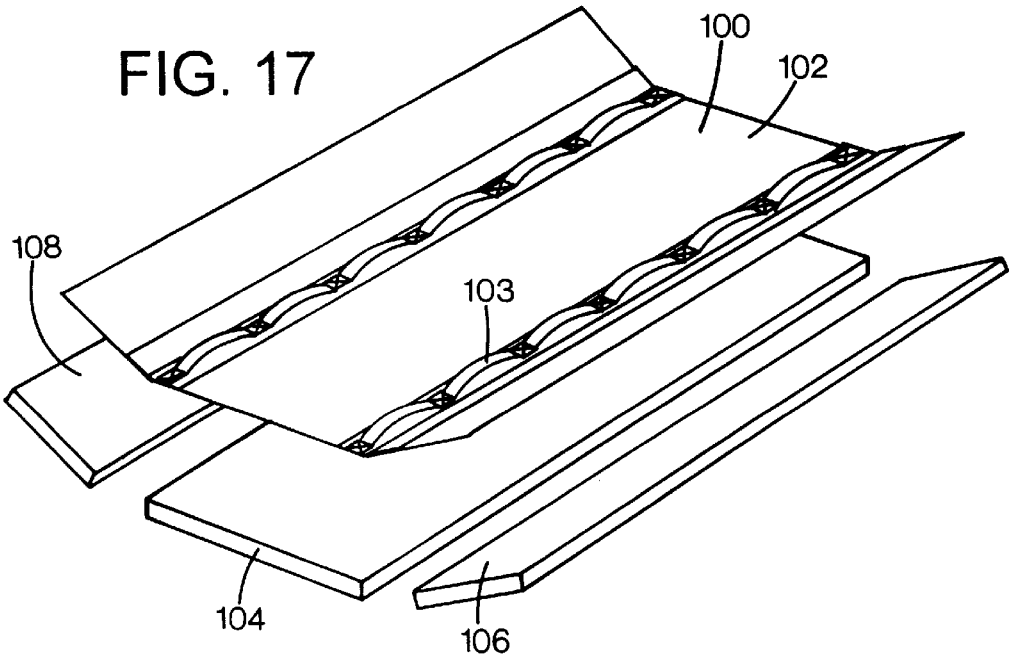
FIG. 17 is a perspective view of the stretcher of the present invention with handles.

FIG. 17 shows a detailed view of an underside of the layer 102 including two rows of handles 103. It should be understood that the layers 104, 106, 108 may be removably attached to the support layer 102 so that the patient may use his or her own mattress instead of the layers.

Figure 18:
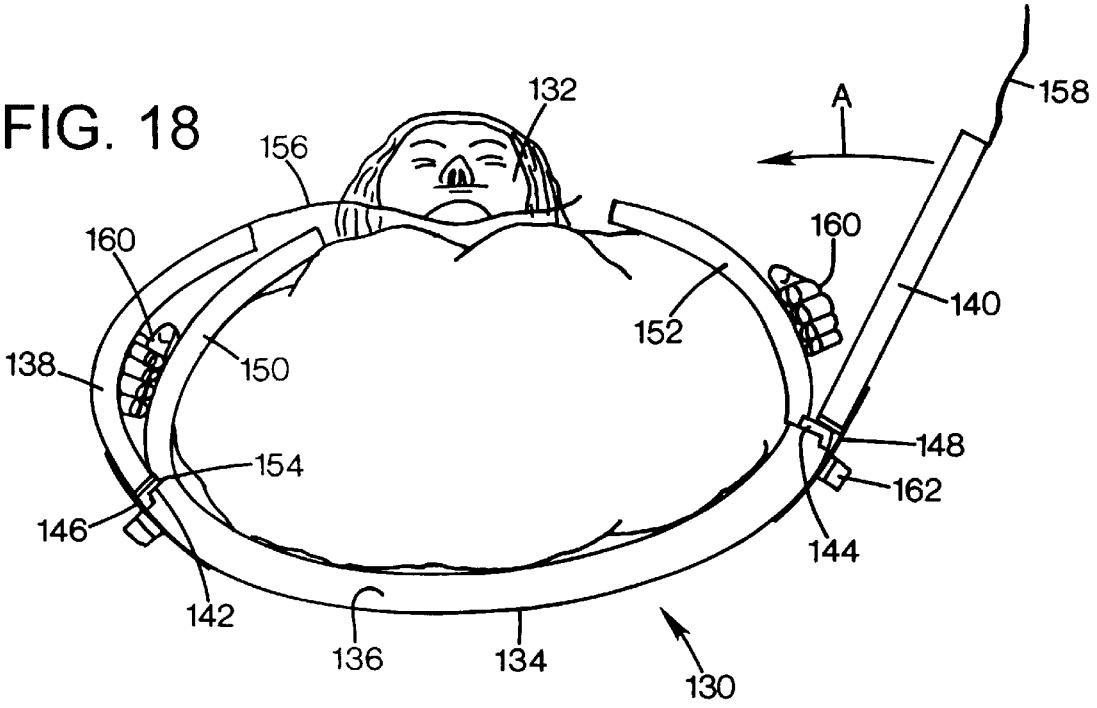
FIG. 18 is a perspective side view of the stretcher of the present invention enclosing a patient.

FIG. 18 shows an alternative embodiment of a carrier 130 enclosing a patient 132. The carrier 130 has a continuous support layer 134 that is attached to a thick mid-section 136 and outer side sections 138, 140. Similar to FIG. 15, the carrier 130 may include elongate support members 142, 144 that are attachable at the folding lines 146, 148. Inner side sections 150, 152 are attached to an upper edge 154 of the mid-section 136. The sections 150, 152 may have attachments 156, 158, respectively so that the attachment 156 may be attached to attachment 158, as shown by an arrow A, to permit the arms and hands 160 of the patient to be disposed between the inner and outer side sections. A first handle 162 may be attached to an underside of the layer 102 at the folding lines 146, 148 to permit the lifting and dragging of the carrier 130 with the patient enclosed inside the inner side sections 150, 152 and the mid-section 134.

While the present invention has been described in accordance with preferred compositions and embodiments, it is to be understood that certain substitutions and alterations may be made thereto without departing from the spirit and scope of the following claims.

I claim:

1. A foldable carrier, comprising:

a first elongate flexible layer having a shape and a first thickness, the first elongate flexible layer having longitudinal opposite side edges;

a second elongate layer made of a porous and soft material, the second elongate layer having a second thickness and being attachable to the first elongate flexible layer, the second thickness being substantially greater than the first thickness, the first elongate flexible layer having a first size, the second elongate layer having a second size;

a first outer side section attachable to the first elongate layer so that a first folding section is defined between the first outer side section and the second elongate layer;

a first inner side section attachable to an upper edge of the second elongate layer at the first folding section;

a second outer side section attachable to the first elongate layer so that a second folding section is defined between the second outer side section and the second elongate layer;

a second inner side section attachable to the upper edge of the second elongate layer at the second folding section;

a first support member disposed in the first folding section; and a second support member disposed in the second folding section.

2. The foldable carrier according to claim 1 wherein the first outer side section is attached to the second outer side section.

3. The foldable carrier according to claim 1 wherein the first and second inner side section are bendable towards one another inside the first and second outer side sections.

4. The foldable carrier according to claim 1 wherein a handle section is attached to an outside of the first elongate layer.

5. The foldable carrier according to claim 1 wherein a handle section is attached to an outside of the first elongate flexible layer so that the handle section extends from a first stretcher side section to the second elongate layer over the first folding section.

6. The foldable carrier according to claim 5 wherein the handle section has a handle protruding away from the first elongate layer.

7. The foldable carrier according to claim 6 wherein the first inner section is attached to an upper edge of the second elongate layer, the upper edge being remote from the handle section.

8. The foldable carrier according to claim 7 wherein the second inner section is attached to the upper edge of the second elongate layer, the upper edge being remote from the handle section.

* * * * *